US008272156B2

(12) United States Patent
Gimpel et al.

(10) Patent No.: US 8,272,156 B2
(45) Date of Patent: Sep. 25, 2012

(54) RETRACTABLE BANNER STANDS

(75) Inventors: Dixon Gimpel, Prior Lake, MN (US); Scott Parizek, Lakeville, MN (US)

(73) Assignee: Skyline Displays, Inc., Eagan, MN (US)

( * ) Notice: Subject to any disclaimer, the term of this patent is extended or adjusted under 35 U.S.C. 154(b) by 179 days.

(21) Appl. No.: 12/607,920

(22) Filed: Oct. 28, 2009

(65) Prior Publication Data

US 2010/0146832 A1 Jun. 17, 2010

Related U.S. Application Data

(60) Provisional application No. 61/109,139, filed on Oct. 28, 2008.

(51) Int. Cl.
*G09F 17/00* (2006.01)

(52) U.S. Cl. ..... 40/604; 40/603; 40/610; 40/606.01

(58) Field of Classification Search ..... 40/604, 40/610, 601, 607.04, 607.1, 606.19; 160/122, 160/121.1, 120, 25, 24
See application file for complete search history.

(56) References Cited

U.S. PATENT DOCUMENTS

| | | | | |
|---|---|---|---|---|
| 638,434 | A | 12/1899 | Woodman | |
| 4,288,937 | A * | 9/1981 | Virsen | 40/505 |
| 4,700,498 | A | 10/1987 | Perutz et al. | |
| 5,581,401 | A | 12/1996 | Takamoto et al. | |
| D391,298 | S | 2/1998 | Johnson et al. | |
| 5,798,861 | A | 8/1998 | Doat | |
| 6,370,803 | B1 | 4/2002 | Burquest | |
| D468,362 | S | 1/2003 | Zarelius | |
| 6,571,496 | B2 * | 6/2003 | Zarelius | 40/514 |
| 6,643,966 | B2 | 11/2003 | Schmitt | |
| 6,718,669 | B1 * | 4/2004 | Hayes | 40/610 |
| 7,237,350 | B1 | 7/2007 | Zarelius | |
| 7,337,567 | B2 | 3/2008 | Fritsche et al. | |
| D578,574 | S | 10/2008 | Lundgren | |

(Continued)

FOREIGN PATENT DOCUMENTS

KR 20-0249128 Y1 10/2001

OTHER PUBLICATIONS

Application and File history for U.S. Appl. No. 29/346,215, filed Oct. 28, 2009. Inventors: Dixon Gimpel et al.

(Continued)

*Primary Examiner* — Lesley D Morris
*Assistant Examiner* — Christopher E Veraa
(74) *Attorney, Agent, or Firm* — Patterson Thuente Christensen Pedersen, P.A.

(57) ABSTRACT

Retractable banner stands each comprises a base including a housing containing an extendable and retractable banner, the housing having a slot through which the banner is extended and retracted. The base includes sockets for receiving vertical poles for attachment of accessories. Such accessories can include banner support structure for an additional banner to be positioned intermediate two of said retractable banner stands whereby a three banner interconnected display may be provided with each of the banners visually separated. Such a display is highly suitable for a backwall for a tradeshow display area. Further accessories include shelves, literature holders, lighting, and electronic display screens. The base may include a housing with a pair of floor engaging saddles, each saddle with a pair of feet portions extending forwardly and rearwardly from the housing on two ends of the housing, the feet having the sockets for receiving said vertical poles.

18 Claims, 13 Drawing Sheets

U.S. PATENT DOCUMENTS

| | | | | |
|---|---|---|---|---|
| D598,501 | S | 8/2009 | Merner et al. | |
| D608,830 | S | 1/2010 | Taylor et al. | |
| D608,831 | S | 1/2010 | Taylor et al. | |
| D611,102 | S | 3/2010 | Taylor et al. | |
| D613,798 | S | 4/2010 | Taylor et al. | |
| D616,944 | S | 6/2010 | Taylor et al. | |
| D620,529 | S | 7/2010 | Taylor et al. | |
| D620,530 | S | 7/2010 | Taylor et al. | |
| 2002/0050083 | A1 | 5/2002 | Zarelius | |
| 2002/0121034 | A1 | 9/2002 | Schmitt | |
| 2005/0081413 | A1 | 4/2005 | Ko | |
| 2005/0166430 | A1 | 8/2005 | Zarelius | |
| 2006/0216686 | A1* | 9/2006 | McComb et al. | 434/408 |
| 2007/0257170 | A1* | 11/2007 | Whittemore et al. | 248/229.16 |
| 2008/0005945 | A1 | 1/2008 | Fritsche et al. | |
| 2009/0056184 | A1* | 3/2009 | Fritsche et al. | 40/604 |
| 2010/0050489 | A1 | 3/2010 | Merner et al. | |
| 2010/0139135 | A1 | 6/2010 | Taylor et al. | |
| 2010/0146832 | A1 | 6/2010 | Gimpel et al. | |

OTHER PUBLICATIONS

Application and File history for U.S. Appl. No. 29/346,216, filed Oct. 28, 2009. Inventors: Dixon Gimpel et al.

Application and File history for U.S. Appl. No. 29/346,217, filed Oct. 28, 2009. Inventors: Dixon Gimpel et al.

Application and File history for U.S. Appl. No. 12/691,486, filed Jan. 21, 2010. Inventors: Scott Parizek et al.

* cited by examiner

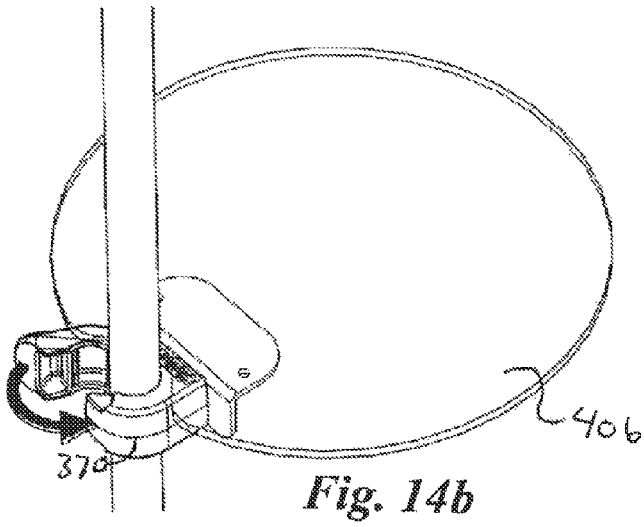
Fig. 14b
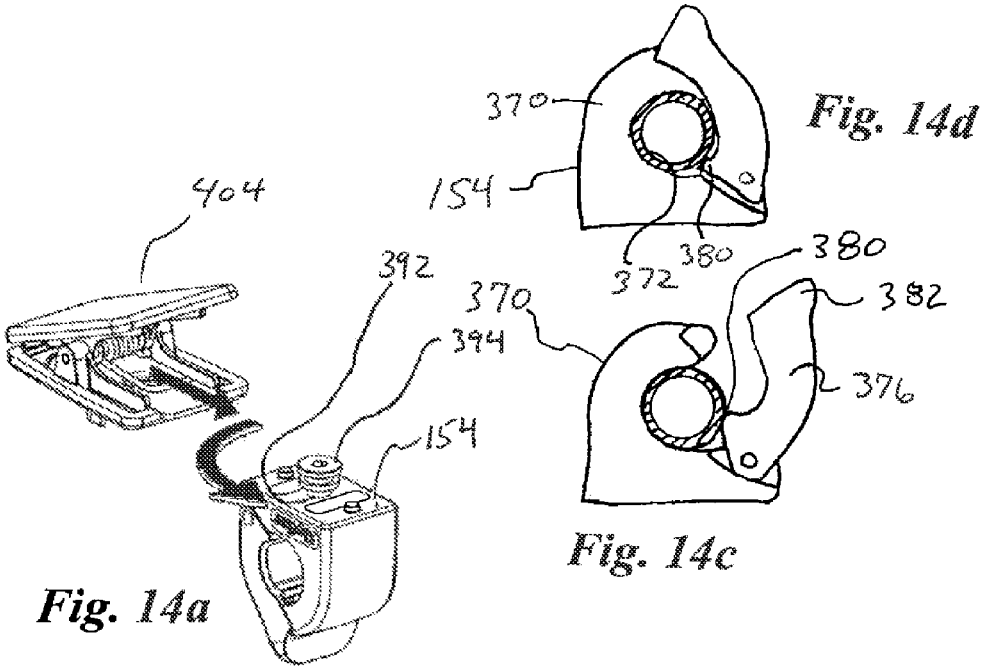
Fig. 14d
Fig. 14c
Fig. 14a

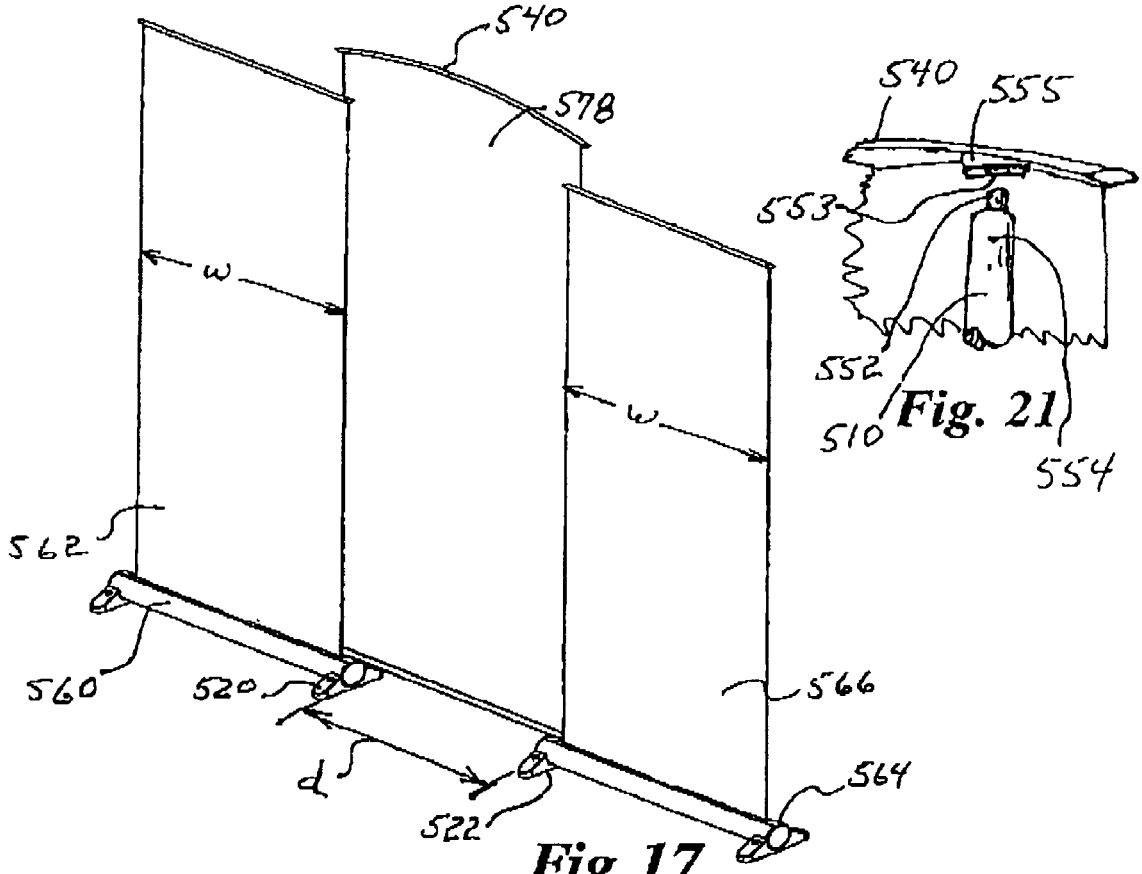
Fig. 21
Fig. 17.
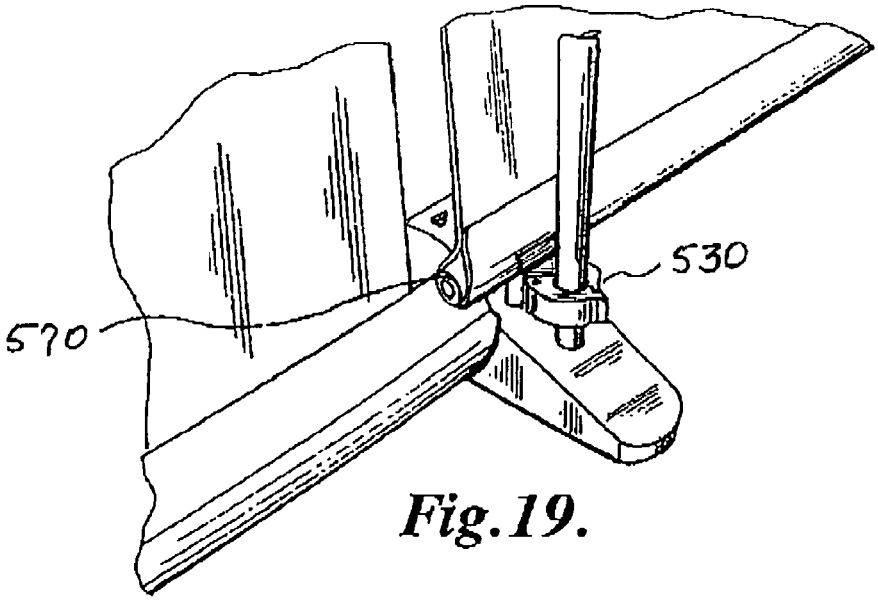
Fig. 19.

RETRACTABLE BANNER STANDS

RELATED APPLICATIONS

The present application claims the benefit of U.S. Provisional Application No. 61/109,139, filed Oct. 28, 2008, which is incorporated herein in its entirety by reference.

This application is also related to U.S. Design application No. 29/346,215, filed Oct. 28, 2009, U.S. Design application No. 29/346,216, filed Oct. 28, 2009, U.S. Design application No. 29/346,217, filed Oct. 28, 2009, and U.S. Provisional Application No. 61/205,660, filed Jan. 21, 2009, the disclosures of which are hereby incorporated by reference in their entirety.

FIELD OF THE INVENTION

This invention relates to free standing and readily erectable graphic displays such as those used for trade shows. More particularly, this invention relates to retractable banner stands with accessories.

BACKGROUND OF THE INVENTION

Displays for trade shows are generally structures that can transported, erected on a convention or show floor for a brief period of show time, then disassembled, transported and stored until the next usage. Such displays can be massive complex multi-story structures or simple single banner displays. The massive displays are typically constructed of metal trusses, metal box frames, and large diameter (greater than two ½ inches) metal tubing providing great flexibility in varying designs and offering many accessories such as shelving, lighting, literature racks, and flat panel electronic displays. Such large displays often require crates to store and transport and require trained crews several hours or more to erect. See, for example, U.S. Pat. No. 7,024,834 assigned to Skyline Displays, Inc., the owner of this invention, illustrating such displays and U.S. Pat. No. 6,951,283 illustrating a crate and such displays.

A common simpler tradeshow display comprises a bundled network of interconnected support rods that expands into a volumetrically substantial three-dimensional space. Such expanded structures are then covered with sheet material capable of supporting graphics on the material. Such structures typically have a curved foot print providing an attractive smooth curved surface for the graphics. Such displays may also have vertical supports that may be utilized for supporting shelving and other accessories. The curved footprint effectively provides stability and allows shelves and other appurtenances such as lighting. See U.S. Pat. Nos. 6,829,869 and 4,658,560 assigned to Skyline Displays, Inc., the owner of the instant application. These displays are simple enough that they may be erected by users of the display but often, especially with accessories, such erection and take down is commonly done by hired contractors.

Perhaps the simplest displays usable in trade shows and other settings where simple graphic banners or signs or any visual information is to be temporarily displayed, are retractable banner stands. Such stands offer the distinct advantage that such displays can be easily transported by, quickly and easily erected by and taken down by the show attendants that will be using the display. Such displays can also divide space and support visual graphical displays for viewing by attendees. These displays are quite simple, comprising a housing with a retractable banner therein, a pole that plugs into the housing for supporting the screen in an extended position, and one or two stabilizing feet that rotate outwardly.

Such banner stands can be seen in U.S. Pat. Nos. 6,571,496, D468,362, U.S. Patent Application Publication 2002/0050083, and PCT Application Nos. WO 01/91092, WO 01/35381, and WO 00/47508, which are all directed to various aspects of retractable banner stands. These applications and publications are incorporated by reference herein in illustrating conventional retractable banner stand mechanisms and components. Retractable banner stands also provide the advantages protection and storage of the graphic display banner in the housing when the display is not in use. A disadvantage of such displays is that they are not typically as stable as the displays comprising the network of support rods described above and certainly not as stable as the larger displays constructed of trusses, metal box frames, and large diameter tubing. Nor do retractable banner stands have the three dimensional depth associated with the displays comprising the network of support rods, nor do such displays typically have shelves or capabilities of supporting appurtenances such as lighting, brochure racks or bins, display screens, and other electronics due to the lack of structure for attachment of same.

The core in such retractable banner stands comprises a cylindrical tubular base with an attachment point for the end of a banner and the banner windable on the exterior of the tubular base. A first end with an axially extending tab centrally positioned and attached to an inner hub and affixed to one end of a torsion spring, an outer hub rotatable and radially positioned with respect to the inner hub and tab and affixed to the other end of the torsion spring. The outer hub affixed to the cylindrical outer tubular housing. Conventionally, the tab is secured from rotation by insertion through a slot in the housing such that the tab is exteriorly exposed. An axle configured as a round pin extends from the second end of the core and typically extends out of the housing from the end opposite the tab allowing the core to rotate thereabout. Conventionally, the banner width will extend approximately 90 to 95% of the length of the housing.

Such retractable banner stands may be positioned end-to-end, often in a group of three to provide a backwall to an exhibit space. Such exhibit spaces are often sold with typical widths of 10 feet or 3 meters and three banner stands positioned end-to-end with typical banner widths of 32 to 38 inches conveniently provide a relatively inexpensive and easily erectable back wall for such exhibit spaces. Although three identically sized banner stands and banners, with the banners in alignment are suitable for such backwalls, such an arrangement can be visually improved or made more interesting by varying the depths and shapes of the banners. It is always advantageous to provide such variation and shape differentials with minimal expense and ease of erection of such back walls. The improvements and inventions herein provide such advantages to back walls formed of retractable banner stands.

SUMMARY OF THE INVENTION

A retractable banner stand, in one embodiment, has a base with a housing containing an extendable and retractable banner, the housing having a slot through which the banner is extended and retracted, a floor engagement portion of the base, such as a pair of feet extending forwardly and rearwardly, on two ends of the housing having sockets for receiving vertical poles, the vertical poles insertable into said sockets and extending upwardly along the banner when the banner is extended. The vertical poles may be utilized to support accessories. A vertical post for supporting the extended banner is secured to the housing and extends upwardly behind the banner.

The feet may be permanently attached and/or fixed to the housing, or they may in certain embodiments be removable or pivotal.

In a preferred embodiment a backwall for a display area, such as at a tradeshow, may be created with two such banner stands in end-to-end alignment and spaced from each other. The vertical poles may be inserted at the inside ends of the housings of the two space apart banner stands and a horizontal cross member may be utilized to suspend a third banner in-between the banners of the two spaced apart banner stands.

With respect to an embodiment of the individual retractable banner stands, a conforming horizontal bar is attached to the top edge of the banner, the bar having no outward and upward protrusions and seats on the top of the vertical banner support post. A selection of accessories may be attached onto variable vertical positions on the tubing by way of tubing clamps. The accessories may be selected from the group of shelves, literature holders, lighting, and electronic display screens. Additional accessories may have downwardly facing sockets to engage the top of the vertical poles, such as a horizontal cross member for an additional banner. In a preferred embodiment, the feet are provided by a pair of saddles at each end of the banner housing, each saddle having a curved surface for receiving the housing and a pair of outwardly extending feet with upwardly extending sockets, the housing secured to the feet. In particular embodiments, the saddles are located axially outboard from the banner core, providing a more stable base than conventional retractable banner stands. In an embodiment the saddles are fixed to An advantage of the positioning and fixation of the feet so positioned is that the erected banner stand can be tipped forwardly and rearwardly for attachment of accessories particularly to the horizontal banner support bar.

A feature and advantage of certain embodiments of the invention is that a retractable banner stand provides a banner with a shelf extending across the front face of the banner. The shelf having two ends and supported on each end by a pole extending upwardly from a socket in one of two forward feet stabilizing a housing from which the banner extends and retracts.

A feature and advantage of the invention is that a housing containing the core is provided having a slot through with the banner extends and retracts that receives the conforming horizontal bar that secures the top edge of the banner and that attaches to a horizontal post. The upper surface of the bar is shaped to conform to the exterior surface of the housing and has no upwardly facing discontinuities such as hardware loops or hooks for connecting to the banner support post. The exterior surface of the bar provides a flush surface with the housing exterior surface. A feature and advantage of the lack of hooks, or other attachment hardware, is that the banner can be rolled onto the conforming horizontal bar without projections damaging the banner or graphics thereon. Additionally a very finished look to the housing is provided when the banner is retracted.

A further feature and advantage of the banner stand is that the banners attach to the core by way of a pair of cooperating strip attachment members that removably engage one another. A first strip attachment member is attached to the core, either directly or with a leader piece of sheet material. A second cooperating strip attachment member is secured to the lower bottommost end of the banner with graphics thereon. The two cooperating strip attachment members slidingly or otherwise engage with one another. This provides the advantage of the retractable banner stand user being able to readily switch out banners for the particular housing.

A feature and advantage of particular embodiments of the invention is that the housing provides a readily accessible locking means for securing the banner in an extended position. A movable manual slidable member is advantageously located on the top of the housing laterally adjacent to the slot. The movable member inserts a stop into one of a plurality of apertures in a hub portion of the core locking the core, while under torsional tension, for easy removal of the banner.

A feature and advantage of certain embodiments of the invention is that a retractable banner stand provides a banner with a shelf extending across the front face of the banner. The shelf having two ends and supported on each end by a pole extending upwardly from a socket in one of two forward feet stabilizing a housing from which the banner extends and retracts.

A feature and advantage of the invention is that a pair of posts extending from forwardly extending feet may provide a shelf spanning in front of the banner. Additionally adjacent posts on the sides, that is one inserted into a socket in a rearwardly directed foot and one in a socket in the adjacent forward foot may have a shelf spanning between the two.

A feature and advantage of the invention is that shelves may be utilized in association with a retractable banner stand in a stable foundation.

A feature and advantage of the invention is that stability of the housing with respect to the floor surface is enhanced with the saddle with opposing feet.

Poles may be plugged into the sockets and a plurality of pole clamps and shelves may be attached to the poles to provide overall structural rigidity to the display.

A feature and advantage of particular embodiments is a pole clamp configured with two pieces hinged, one piece comprising a C-shape body portion sized to receive the tubing and the other manually operable handle portion hinged to the C-shape portion and rotatably swingable between an open position where the C-shaped body portion can engage a pole and partially wrap therearound and a pole engagement position where a pole engagement portion on the operable handle portion contact the pole whereby the pole interferes with said rotation and a third position whereby the handle portion is pushed beyond the pole engagement position to an over-center position. Said pole clamp may have attachment portion with a threaded hole therein to receive ancillary pieces such as shelves, racks, brackets, display screens, and lighting.

A feature and advantage of the invention is a retractable banner stand with rigid fixed, non-movable feet positioned at the ends of a housing, the housing containing a core attached to a torsion spring and a banner windable on the core, the housing and feet having an I-shape from the plan view when placed on a floor surface, the feet at the top and bottom of the "I" providing four or more points or regions of contact with the floor surface and having a depth defined by the forward backward length of the feet. The housing and feet in combination with a case with a width sized for the housing and feet and in further combination with shelf accessories sized for the case. The case having trays for holding accessories and vertical posts.

A feature and advantage of the invention is that a first display may be positioned spaced from another like second display with a vertical pole extending from a foot on the first display, a vertical post extending from a foot on the second display, a cross member connecting the two displays, and a banner suspended from the cross member. Pole clamps may be utilized to secure lower corners to the two poles. In this manner a three banner display may be readily provided with two retractable banner stands and a few accessories. Such displays may provide an effective backwall at tradeshow display areas or the like.

A feature and advantage of a three banner display as described above is that the center banner may be forwardly or rearwardly offset from the two banners of the two retractable banner stands. Moreover, the center banner may be easily shaped and sized differently than the two outside banners of the retractable banner stands. For example, the banner can have an arcuate top edge, or a height and/or width greater or lesser than the two banners of the retractable banner stands.

A further feature and advantage of the three banner display is that the alignment of the three banners may be altered from parallel to concave, convex, or other shapes.

FIGURES OF THE INVENTION

Figure 13A:
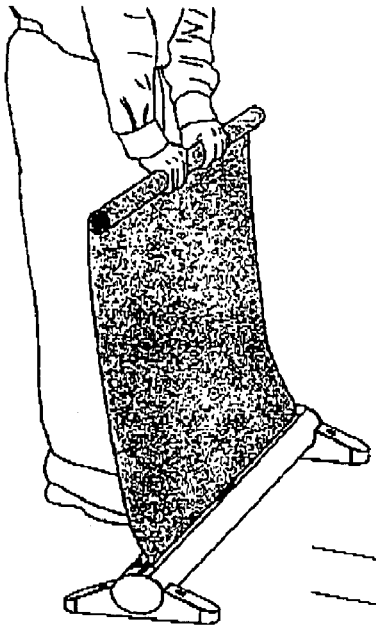

FIG. 13*a* is a front perspective view illustrating the first step in changing out a banner in accord with an embodiment of the invention.

Figure 13B:
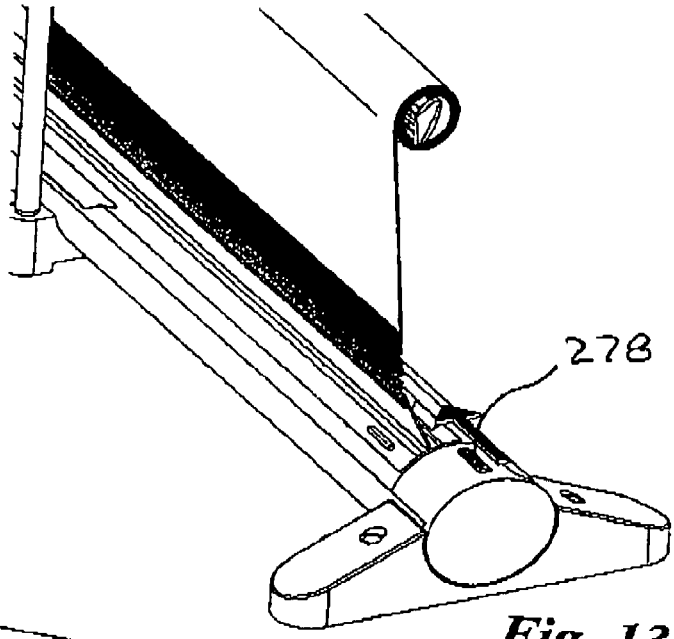

FIG. 13*b* is a perspective view illustrating a second step in removing a banner in accord with an embodiment of the invention.

Figure 13C:
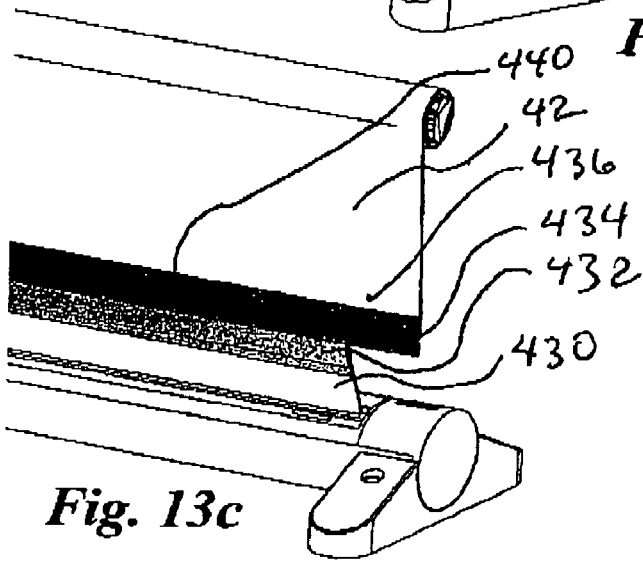

FIG. 13*c* is a third step of removing a banner in accord with an embodiment of the invention.

FIG. 14*a* is a perspective view of a pole clamp and accessory in accord with an embodiment of the invention.

FIG. 14*b* is a perspective view illustrating a step of attachment of the pole clamp with an accessory to a vertical pole with a manually operable handle portion in a first open position.

FIG. 14*c* is a view of a pole clamp in a second position where a manually operable handle portion has been rotated to a pole engagement position.

FIG. 14*d* is a cross-sectional view where the handle portion of the clamp of FIG. 14*c* has been further rotated to an over center position locking the clamp into position.

Figure 15A:
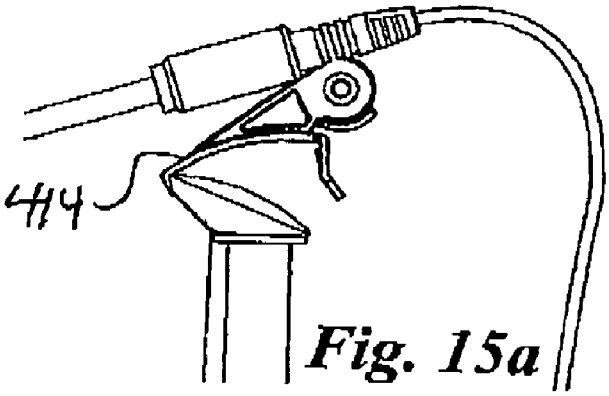

FIG. 15*a* is a side elevational view illustrating an attachment step for attaching a light to the horizontal banner support bar.

Figure 15C:
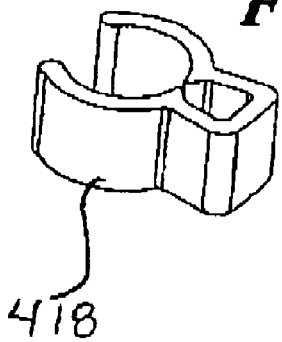
Figure 15B:
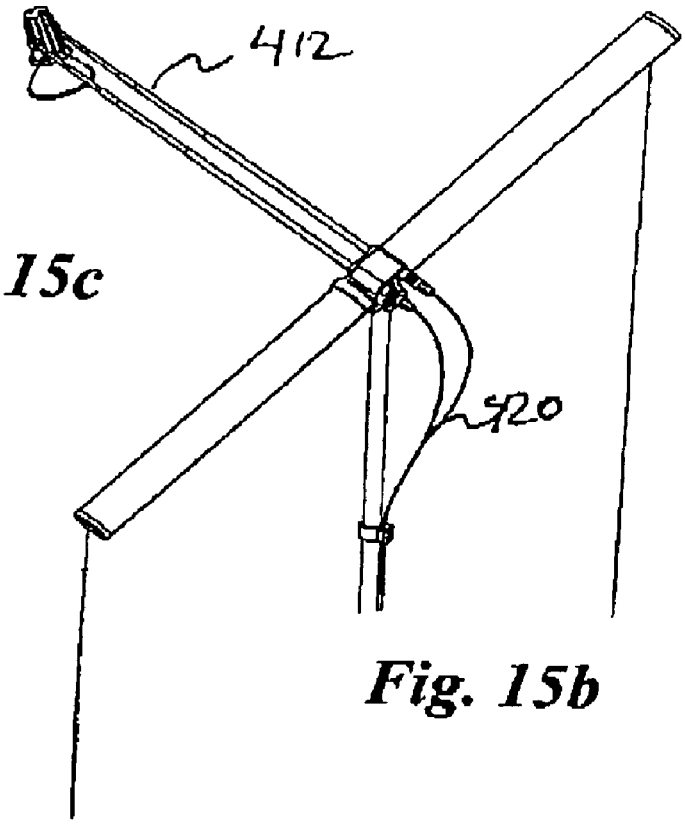

FIG. 15*b* is a perspective view of the light of FIG. 15 positioned on the horizontal bar.

FIG. 15*c* is a perspective view of a clamp suitable for holding a wire for a lamp.

Figure 16A:
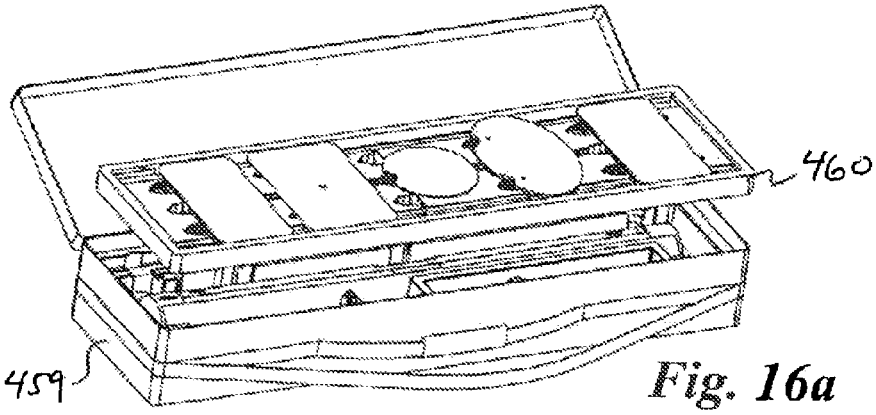

FIG. 16*a* is a perspective view of a carrying case with a pair of trays pursuant to embodiments of the invention.

Figure 16C:
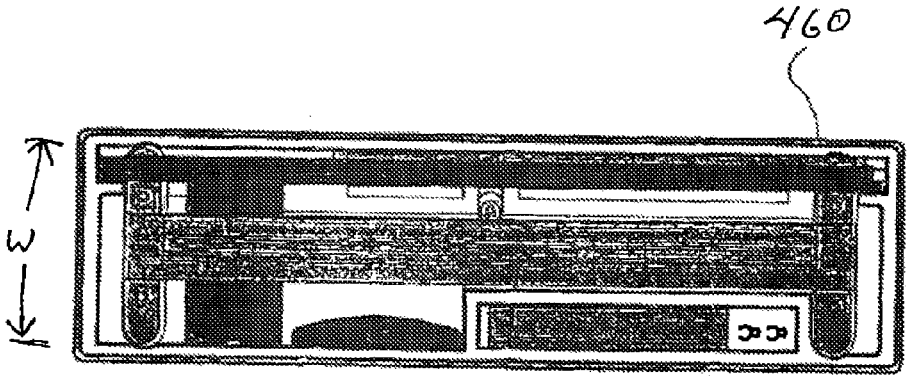
Figure 16B:
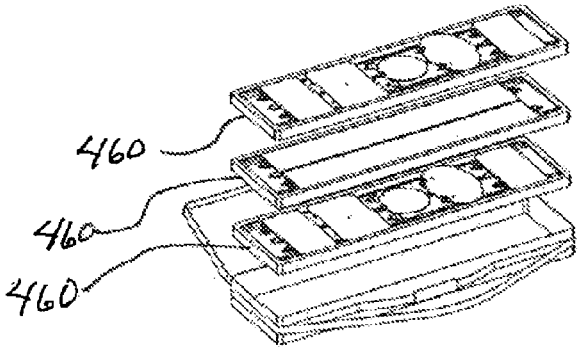

FIG. 16*b* is a top plan view of a tray according to an embodiment of the invention herein.

FIG. 16*c* is another perspective view of a tray according to an embodiment of the invention herein.

FIG. 17 is a front perspective view of a banner stand assembly forming a backwall formed of two retractable banner stands and accessory poles and a horizontal spanning member in accord with aspects of the invention.

Figures 18, 20:
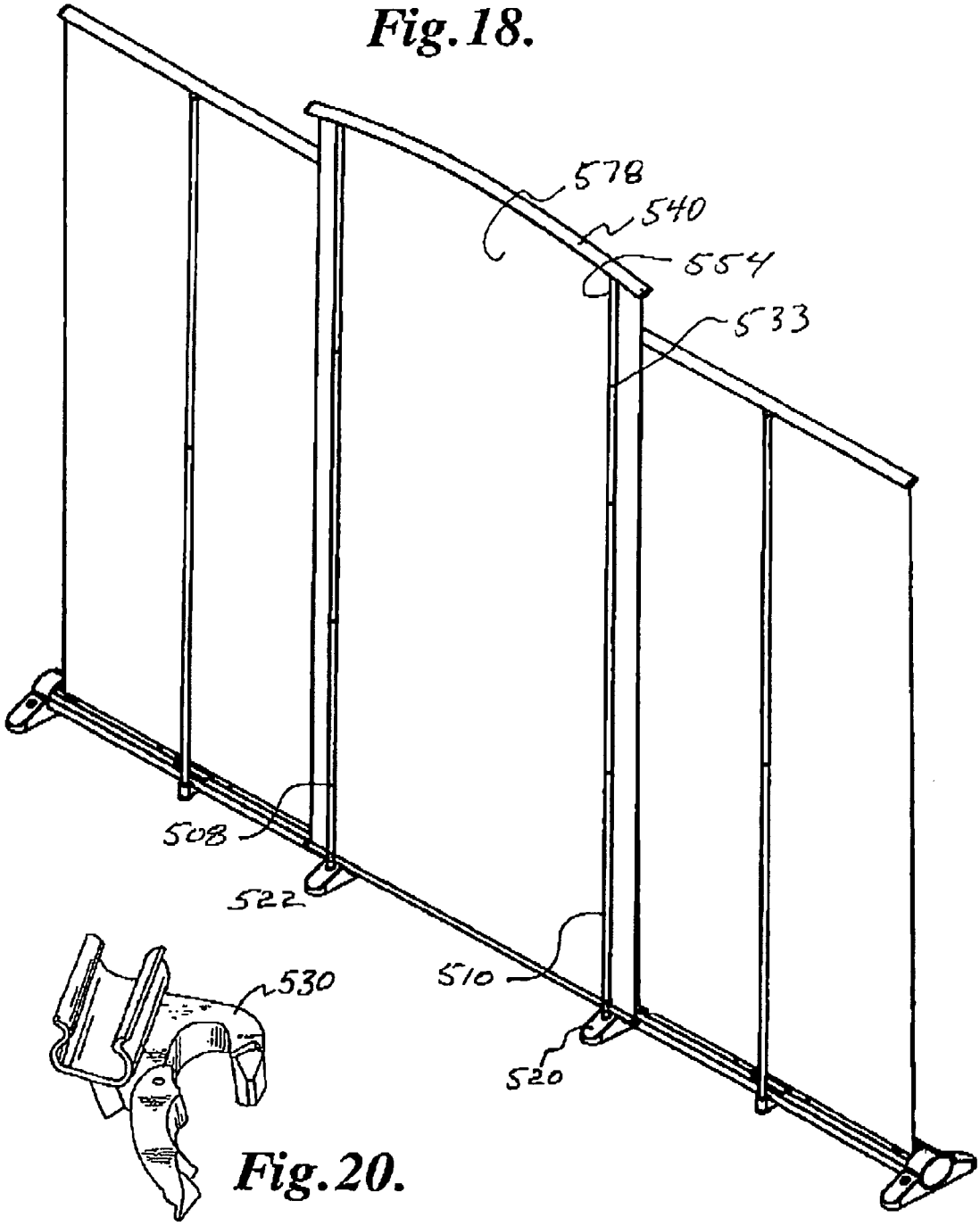

FIG. 18 is a rear perspective view of the banner stand assembly of claim 17.

FIG. 19 is a detail perspective view of the attachment of an intermediate banner to the poles.

FIG. 20 is a perspective view of an over-center clamp and banner clip.

FIG. 21 is a detail view of attachment structure of a horizontal support member to a vertical pole.

DETAILED DESCRIPTION OF PREFERRED EMBODIMENTS

Figure 1:
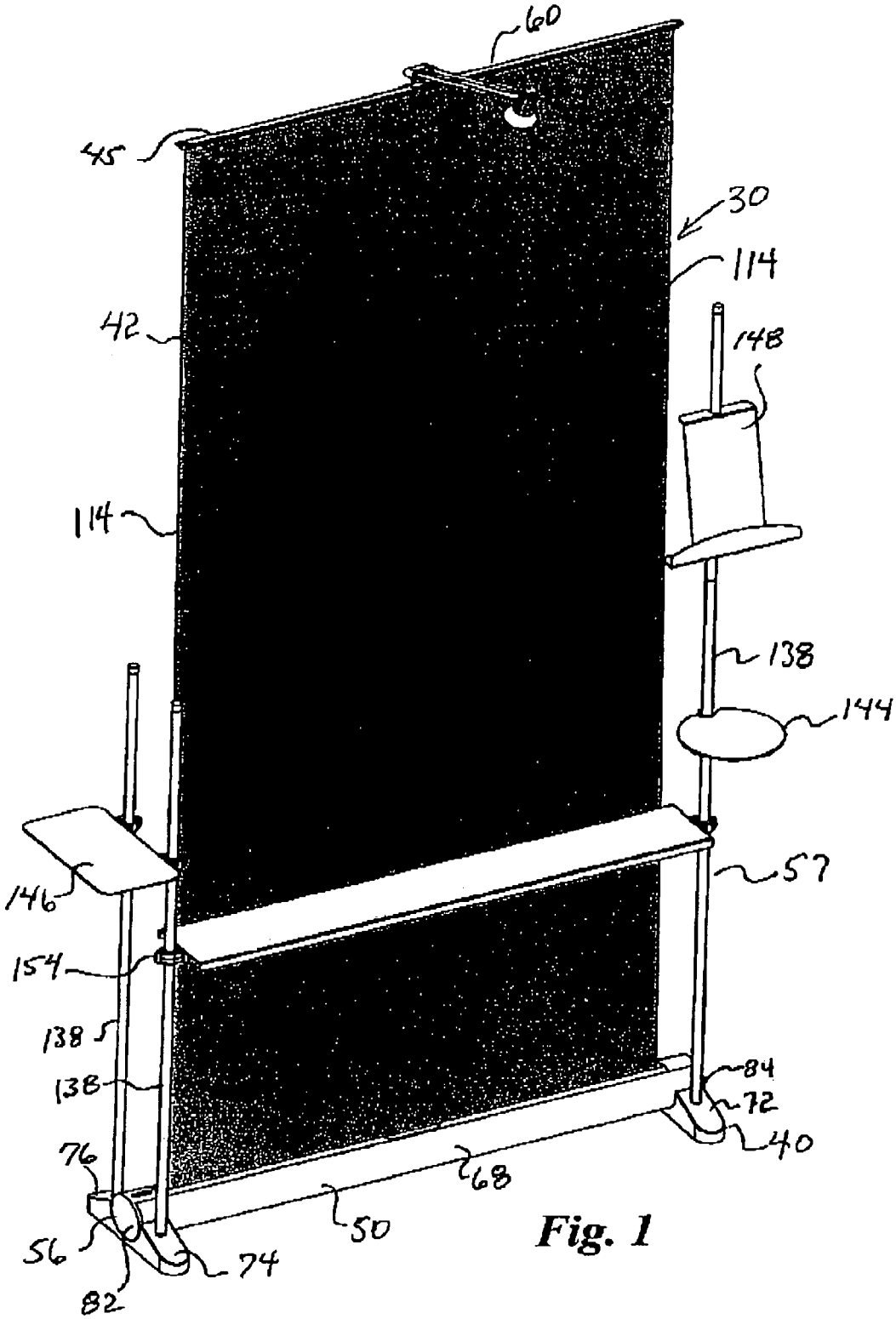
FIG. 1 is an front perspective view of a retractable banner sign assembly with accessories in accord with the invention herein.
Figure 2:
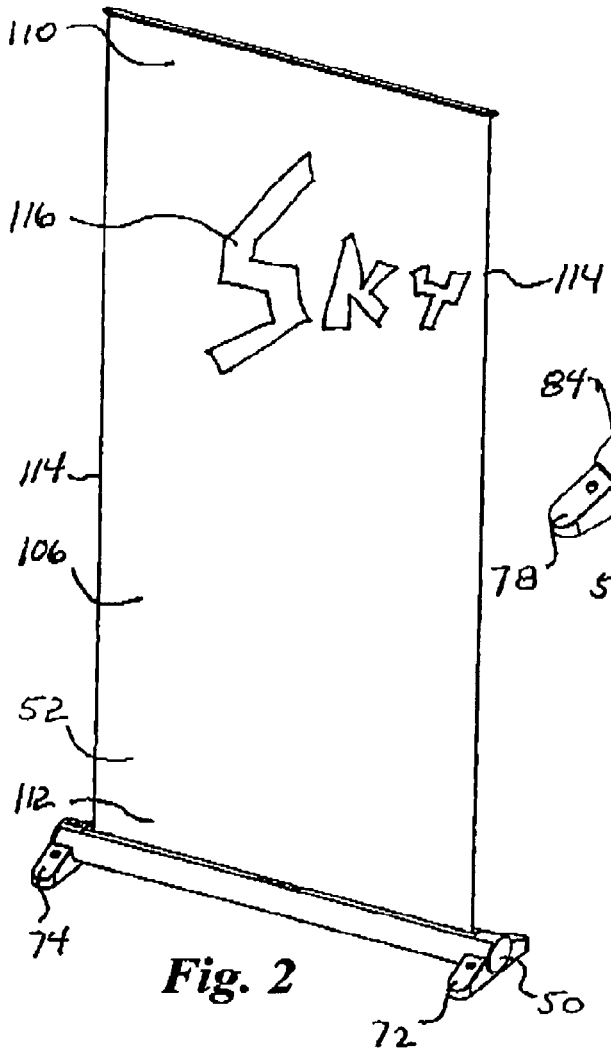
FIG. 2 is a front perspective view of a banner stand in accord with the invention herein.
Figure 3:
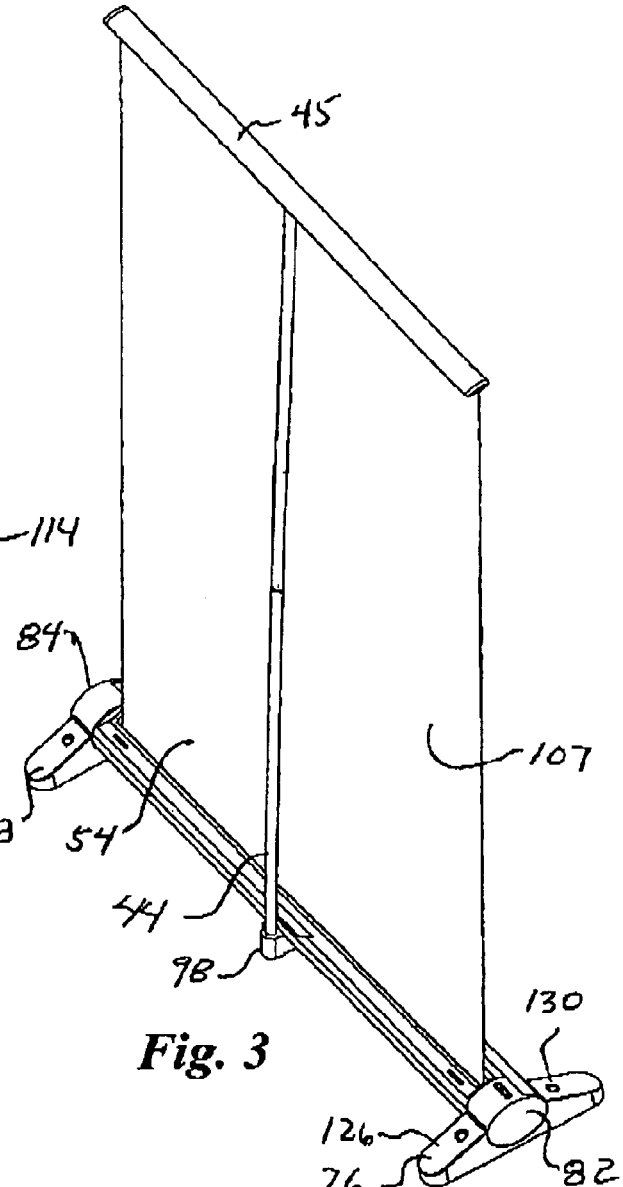
FIG. 3 is a back perspective view of the banner stand assembly of FIG. 2.
Figure 4:
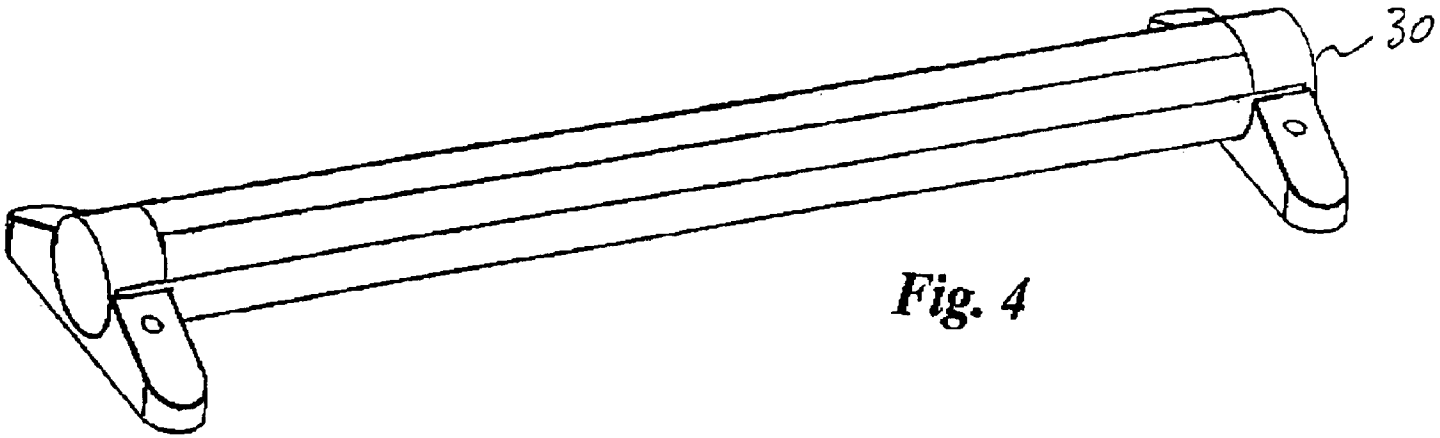
FIG. 4 is an front perspective view of a base of a banner stand with the banner retracted therein in accord with the invention herein.
Figure 5:
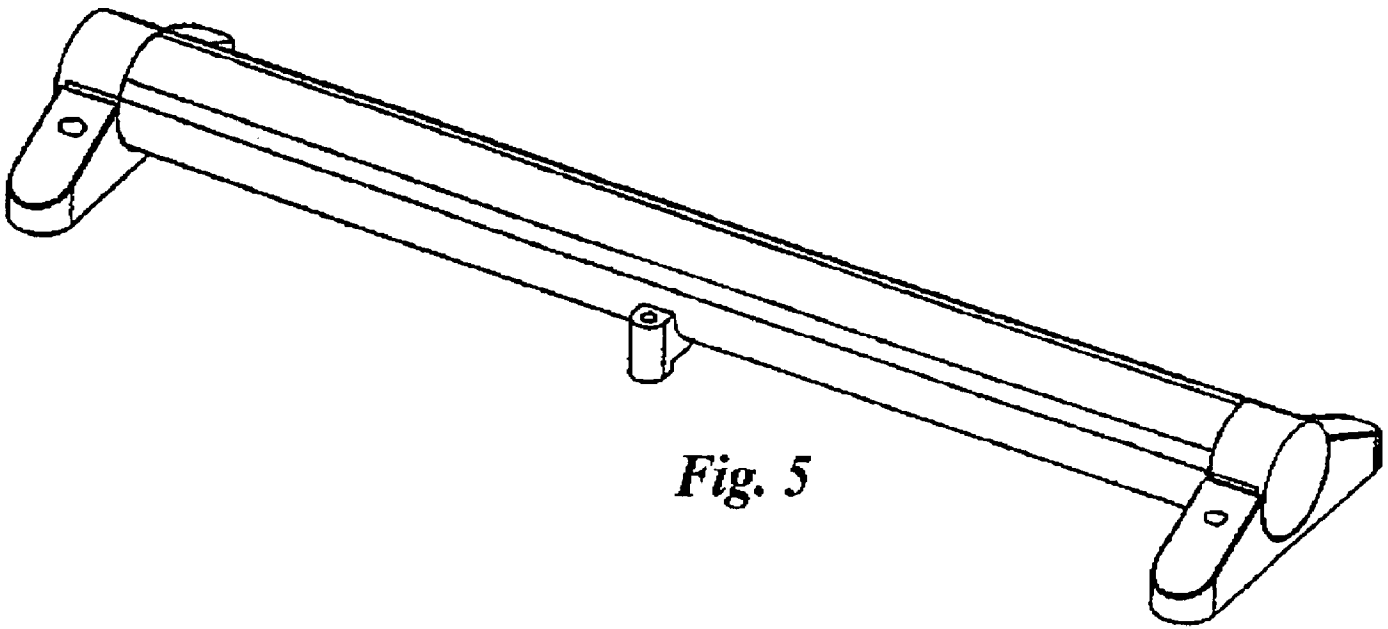
FIG. 5 is a rear perspective view of the banner stand of FIG. 4.

Referring to FIGS. 1-3, a retractable banner stand 30 is illustrated in different configurations. The banner stand assembly is principally comprised of a base 40, a banner 42, a vertical banner support pole 44, and a horizontal banner bar 45. The banner stand assembly has a front side 52 and a back side 54, a left side 56 and a right side 57, a top 60, and a bottom floor facing side 62.

The base 50 is comprised of a housing 68, forward extending feet portions 72, 74, and rearward extending feet portions 76, 78. The feet are positioned at the ends 82, 84 of the housing. Each set of forward and backward feet comprise an integral piece having a conforming upwardly facing surface 90 that is securely assembled to the substantially round shape of the housing 50. Each set of forward and backward feet two feet provides a saddle 94 below the banner housing.

The banner support pole 44 may be formed of two sections that assemble together and that are retained in a pole socket 98 attached to or as part of the base. As illustrated the pole is positioned intermediate the ends of the housing on the back side of the display assembly.

The banner 42 includes a front side 106, a back side 107, and upper portion 110, a lower portion 112, lateral edges 114, and may include a graphic design 116 on the front side of the banner.

Each of the feet 72, 74, 76, 78 are illustrated with the planar incline top surface 126 that tapers downwardly away from the housing. Further, each foot has at least one socket 130 exposed on the top side 132 of the feet for receiving accessory poles 138. Attached to the accessory poles are accessories 144 which may comprise, for example, shelves 146, literature racks 148, electronic display screens, and lighting. The accessories that are attached to the accessory poles are attached by way of clamps 154 described in detail below.

Referring to FIGS. 7, 8, 9, 10 and 11, further details of the retractable banner stand assembly are illustrated.

The base comprises the housing and the saddle with the feet portions, the housing is comprised of a tubular shell portion 202, endcaps 204, 206 and a banner slot defining slot frame 208, the interior 212 of the housing is generally defined by the shell portion 202, the endcaps and the slot defining portion or slot frame 208. A conventional core 220 with the banner 42 wound thereon is contained within the housing. The core has a tab 232 at one end and a cylindrical pin 234 at the opposite end. The tab is affixed to a hub 236 that is affixed to a shaft 228, the inner hub 236 is rotatable within a core shell engagement piece 242, the torsion spring 244 has its inboard end 245 affixed to the inner shaft 228 that extends through the torsion spring 244 and is also fixed to the tab 232. The other end, the outboard end 247, of the torsion spring is affixed to the core shell engagement piece 242. The assembly comprising the torsion spring is inserted into the tubular core shell 246 with the core engagement member 242 fixedly attached to said core shell so there is no rotation relative to each other. The tab 232 is affixed to tab bracket 252 which is suitably attached, such as by screws, to the housing cap 204. The tab is thus non-rotatably secured within said bracket 252. The cylindrical pin 234 is inserted into an aperture and is allowed to rotate freely within the bracket 256 on the opposite end of the housing. Rotation of the core shell will then rotate one end of the torsion spring with the other end, the inboard end 245 remaining fixed, thus "winding up" the spring.

The cylindrical pin end of the core, opposite the tab end, has a locking hub 260 which has a plurality of apertures 264. The locking hub is fixed to the tubular core shell 246. The bracket 256 is suitably attached to the endcap 206 by way of screws or other suitable means. Such a bracket may be an integral part of said end cap. A stop pin 268 is part of an actuator 270 that is constrained within an actuator bracket 274 and an exteriorly exposed manually movable member 278 may be slidingly attached to the bracket 274 and engages the actuator 270. The slidable member 278 can move inwardly (toward the banner) or outwardly to move the pin 268 into an engagement with the locking hub by way of insertion into the apertures 264.

Figure 8:
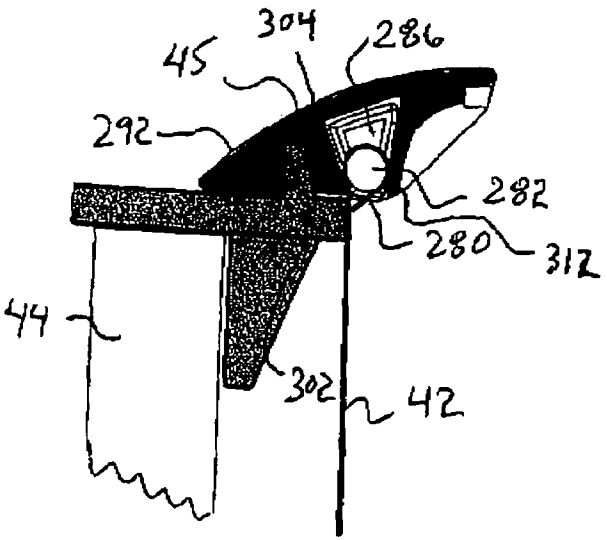
FIG. 8 is an end elevational view illustrating the attachment of the conforming horizontal bar engaged with the banner support pole.

With particular reference to FIG. 8, the banner 42 is secured to the horizontal support bar 45 and may be attached by way of forming a loop 280 in the banner and inserting a dowel 282 into the loop and inserting the looped end with the dowel into the end of the horizontal support bar 45 to be captured in the interior 286 of said bar. Said bar suitably includes an exterior surface 292 which has a curvature or contour that matches or cooperates with the contour of the exterior 298 of the shelled portion 202. The horizontal support bar 45 has a recess 302 facing downward that engages a protrusion 304 positioned at the top of the banner support post 44. This eliminates the conventional hook or hardware loop that other horizontal support bars of conventional banner stands which is important when changing out banners as described below with reference to FIGS. 13*a*-13*c*. The lower shape 312 of the horizontal banner support bar is configured to cooperatively be received within the slot 316 defined by the slot frame 208. When so inserted, the upper surface of the horizontal support bar provides a near continuous surface with the exterior of the housing as defined by the shell 202 and the exterior portion of the slot frame 208.

Figure 11:
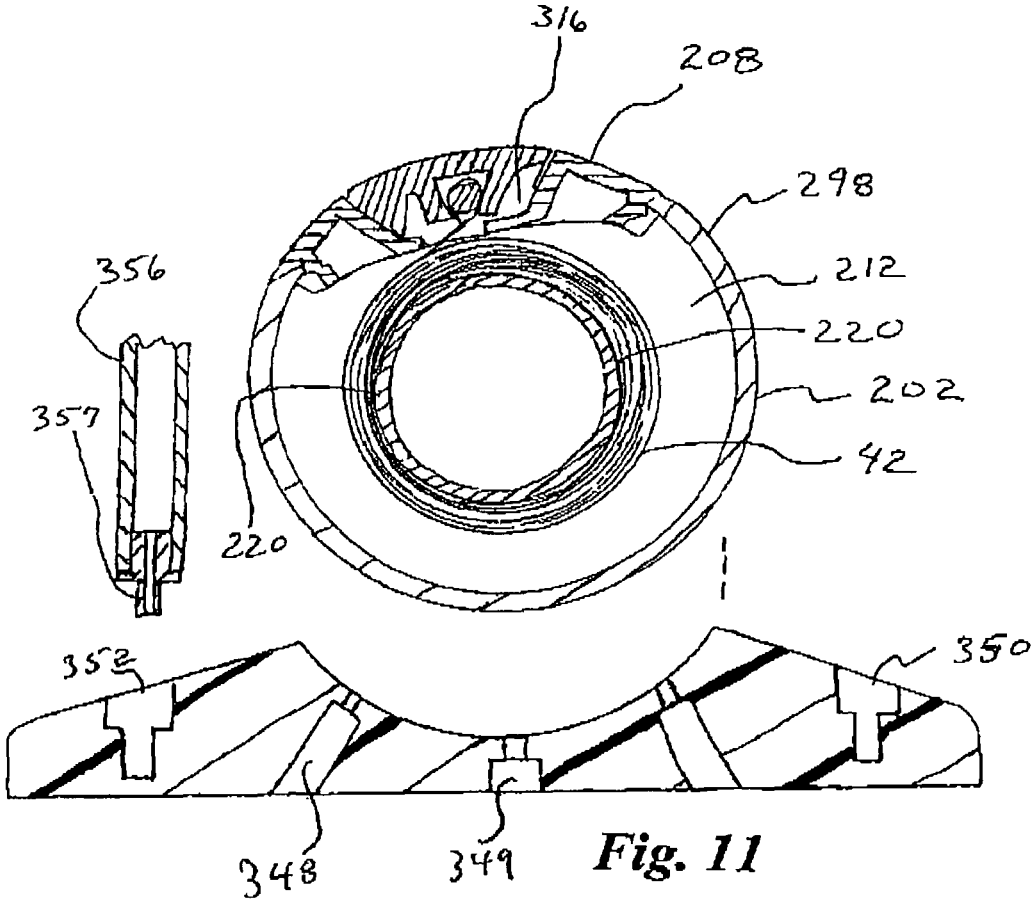
FIG. 11 is a cross sectional view of the housing of the banner stand assembly embodying the invention and a cross sectional view of the feet portions configured as a saddle.
Figure 12:
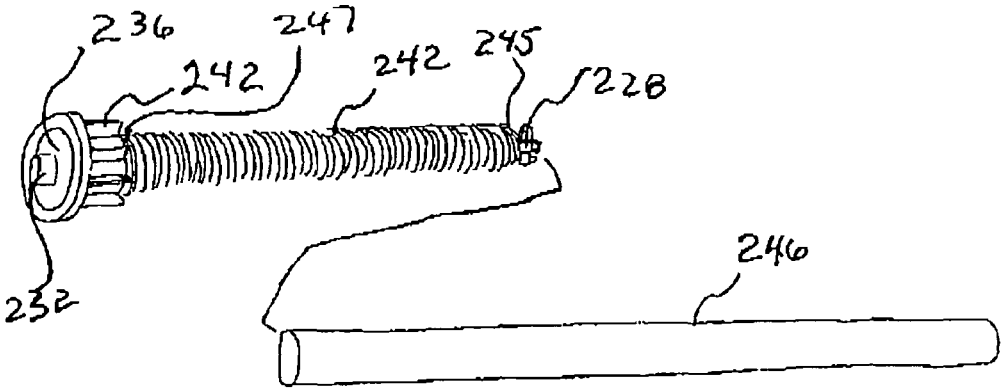
Fig. 12 PRIOR ART
FIG. 12 is a PRIOR ART perspective view illustrating the torsion spring in a core.

With particular reference to FIG. 11, the housing saddles 340, 342 comprising the forward feet and the rearward feet may be attached to the housing suitably by screws such as through the screw ports 348, 349 of FIG. 11. The saddles have sockets 350, 352 formed therein or formed of separate inserts therein that receive the ends of the accessory poles. Such poles are conventionally formed of aluminum tubing 356 and may have two diameter steel inserts 357 at the end at the end of the tubing to be received in the socket. A floor engaging plate 354 may be attached to the bottoms of the saddles, particularly where the saddles are injection molded and internal cavities in the saddle due to molding efficiencies, such as to save polymer material and weight are appropriately covered.

Referring to FIGS. 1, 7, 14*a*-14*d*, details of the attachment mechanisms of the accessories to the vertical accessory poles are illustrated. Flexibility in adjustment, height and rotational position on the pole is provided by the over center clamp 154. Said over center clamp comprises a c-shaped base portion 370 with an interior curve surface 372 shaped to conform to the exterior surface of the accessory poles. A second hinged piece 376 has a tube engagement point 380 and a handle portion 382. This second piece rotates to an interference engagement with the tube as illustrated in FIG. 14*c*. Continued rotation of the second piece causes slight flexing in the second piece, c-shaped piece, and/or tubing to allow the engagement point to move to an over-center position as illustrated in FIG. 14*d*. In such a position the second piece is locked into position with the significant force to hold the clamp at a desired location on the accessory poles. The c-shaped piece may have a threaded aperture 392 for receiving a screw 394 or other threaded member for attachment of the clamp to the accessories or brackets or other members holding the accessories. FIG. 14*a* illustrates a spring loaded clamp 404 as an accessory. FIG. 14*b* illustrates a circular shelf 406. As can be recognized by those familiar with the art, other accessories commonly used in tradeshow displays may be suitably attached to the poles by way of the clamps.

Referring to FIGS. 15*a*, 15*b* and 15*c* a further accessory is illustrated, namely a lamp 412. This lamp has a conforming flexible bracket 414 that may flex to snap onto the upper contoured surface of the horizontal banner support bar. Additional bracket 418 is shaped to snap onto the tube and provide wire management to the lamp power cord 420 as illustrated in FIG. 15. Such a lamp could, of course, be suitably attached to one of the accessory poles.

Referring to FIGS. 13*a*, 13*b* and 13*c*, a method for exchanging out the banners in the retractable banner stand is illustrated. A leader portion 430 is conventionally attached to the core 220. The leader has a sliding hook engagement member 432 that cooperatively engages by sliding with a cooperating engagement member 434 attached to the lower end 436 of the banner 42 to facilitate the switch or replacement of the banner in the banner stand as described herein the banner will be pulled out of the housing and wound up such as illustrated in FIGS. 13*a* and 13*b*. The banner is pulled out sufficiently such that the connection 440 between the leader 430 and the banner 42 is exposed. The moveable member 278 exposed on the top of the housing is moved such as by sliding toward the banner to engage the locking pin 268 with the locking hub 260 to fix the core in a specific rotational position at which point the torsion spring will have sufficient winding torque therein. The banner is removed as illustrated in a sliding fashion from FIG. 13*c* and may be replaced with a different banner in a reverse fashion.

Referring to FIGS. 16*a*, 16*b* and 16*c*, the I-shaped configuration of the housing and feet provides a definitive width for which a case 459 may be suitable sized. This definitive width W provides room in the case for additional accessories such as the accessory poles and the shelves and other suitable hardware or accessories. Separate trays 460 may be utilized to organize the retractable banner stands and accessories.

Referring to FIGS. 17, 18, 19, and 20, the retractable banner stand as illustrated herein may be paired with a like banner retractable banner stand spaced therefrom to form a three banner display suitable as a backwall. Vertical accessory poles 508, 510 extend from the inwardly positioned feet 520, 522. An upper or first horizontal support member 540 extends between the two vertical poles. Such may attach to the vertical pole as shown in FIG. 8 or 21 with a post 552 at the top end 554 of the vertical pole and in a cooperating hole 553 on a fixture 555 attached or part of the horizontal support member 540.

Referring specifically to FIGS. 17 and 18, showing a three banner display suitable as a backwall, a first retractable banner stand 560 with a first banner 562 is spaced a distance d from a second retractable banner stand 564 with a second banner 566. A third banner 578 is positioned intermediate the first and second banners. Intermediate banner support structure 533 comprises vertical poles, upper horizontal support member and a second or lower horizontal support member 570 may be utilized to stabilize and secure the bottom of the third or center banner 578. Said three banners are typically about or slightly less (within 10% of) than 10 feet or 3 meters wide thereby fitting perfectly as a backwall in standard size tradeshow display areas. An intermediate or third banner 578 is suspended from the support structure 533. The lower edge of the banner may be appropriately attached to the lower support member and to the accessory poles by use of the over center clamp 530 as illustrated in FIGS. 19 and 20.

The cross members 540 and 570 may be straight or arcuate. The central or third banner 578 may be sized and shaped differently than the first and second banners.

The first and second banner widths will typically be the same width W. The separation distance d between the banner stands will preferably be within 10% of the width W, or within 20% of the width W.

Figure 7:
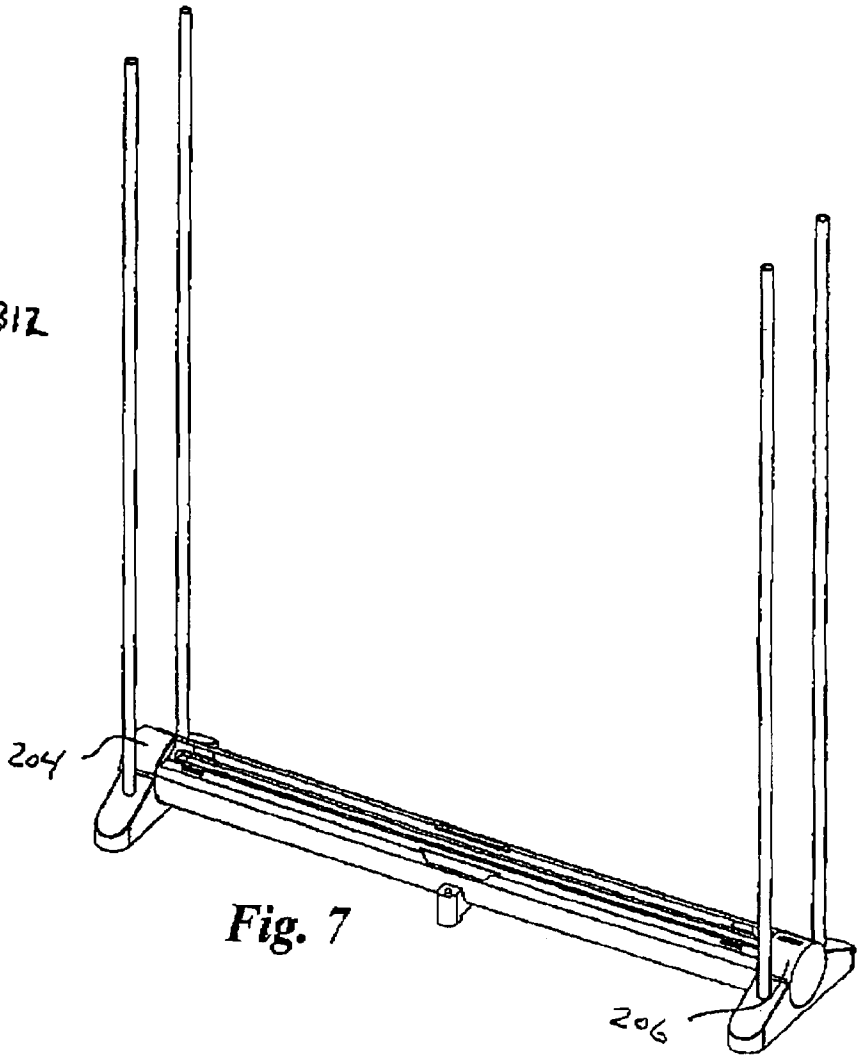
FIG. 7 is a rear perspective view of a banner stand assembly embodying the invention with the banner removed illustrating the receiving slot for the horizontal banner bar.
Figure 6:
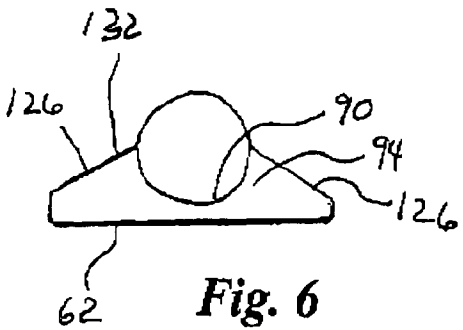
FIG. 6 is a end view of the banner stands of FIGS. 4 and 5. The view from the opposite side being a mirror image thereof.
Figure 9:
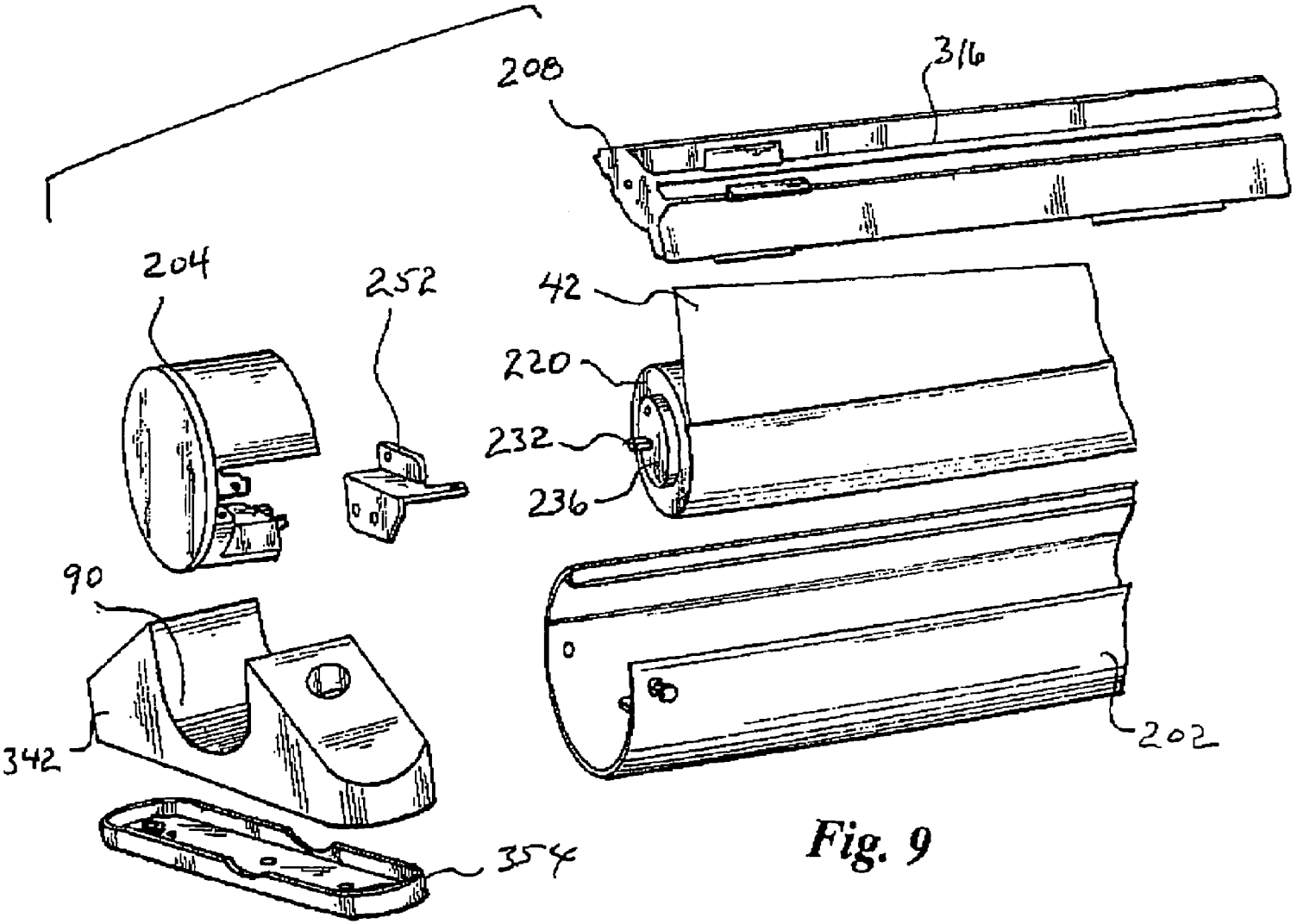
FIG. 9 is an exploded view of one end of the banner stand according to the invention.
Figure 10:
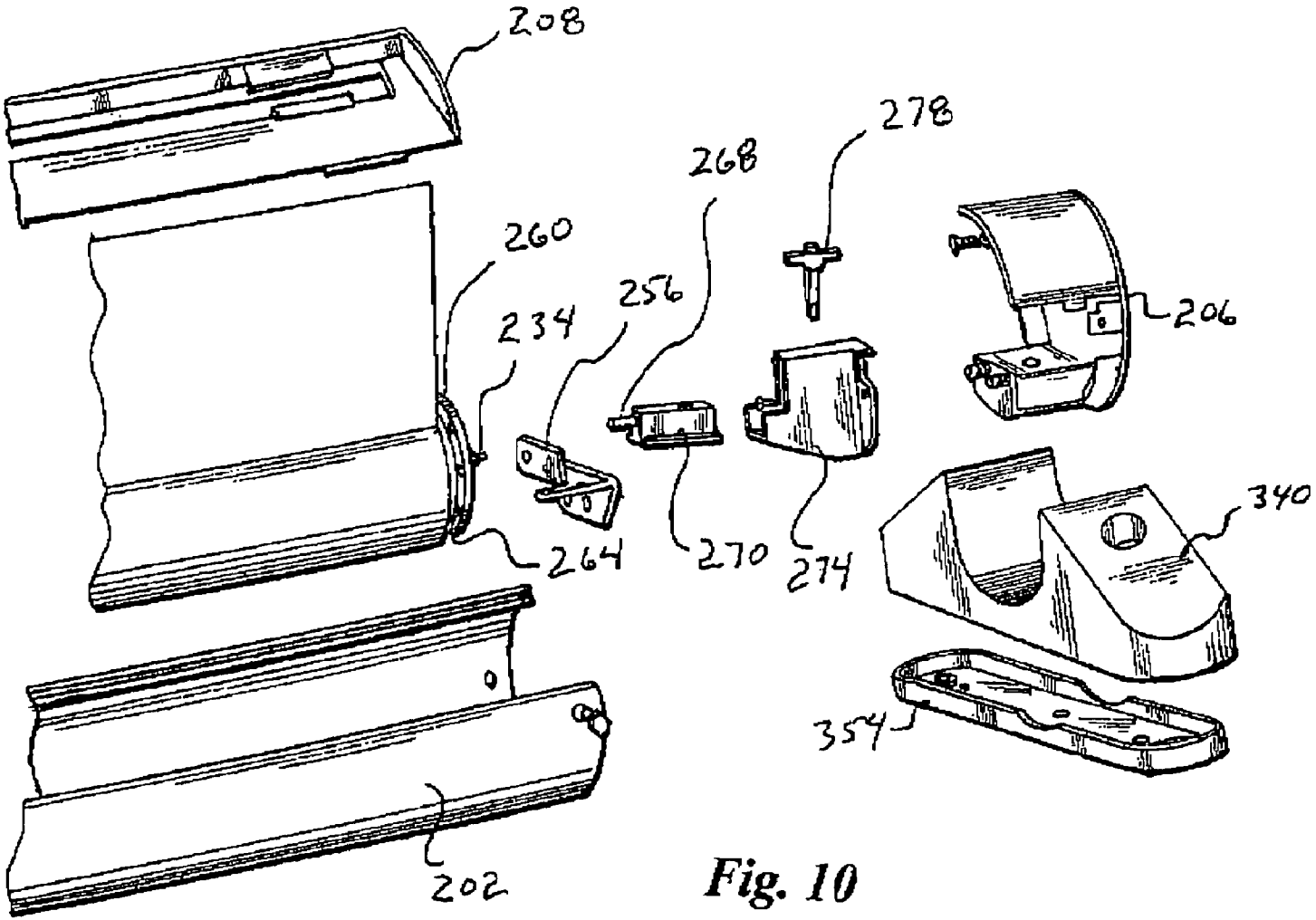
FIG. 10 is an exploded view of the other end of the banner stand of FIG. 9.

The invention also includes modifying existing banner stands to provide a banner not extended from a retractable banner stand in between two banners of two retractable banner stands. In such a case, saddle members such as illustrated in FIGS. 6, 7, and 9 may be added to conventional banner stand housings to provide for receiving the central banner support structure 533, comprising, for example, vertical poles and cross members.

The embodiments above are intended to be illustrative and not limiting. Additional embodiments are within the claims. In addition, although the display and banner magnets have been described with reference to particular embodiments, those skilled in the art will recognize that changes can be made in form and detail. Any incorporation by reference of documents above is limited such that no subject matter is incorporated that is contrary to the explicit disclosure herein.

We claim:

1. A three banner display for a trade show or the like comprises pair of retractable banner stands arranged in a end-to-end spaced configuration, each banner stand comprising a base with a pair of ends and a retractable banner extended from within said base, the pair of banner stands each having a vertical pole positioned at the end the of the respective banner stands adjacent the other banner stand, an upper horizontal cross member extending between the vertical poles, a banner suspended downwardly from the horizontal cross member and positioned intermediate the respective banner stands.

2. The three banner display of claim 1 wherein the backwall has a front side, and extends left and right when viewed from the front, and wherein first banner is separated from the third banner and the second banner is separated from the third banner.

3. The three banner display of claim 2 wherein the third banner is positioned one of forwardly from the second and third banner and rearwardly of the first and second banner.

4. The three banner display of claim 1 wherein the first banner and second banner are in coplanar alignment, and wherein the vertical poles extend from the bases at one of a position forwardly of the first and second banner and a position rearwardly of the first and second banner.

5. The three banner display of claim 4 wherein the third banner is in coplanar alignment with the vertical poles.

6. The three banner display of claim 1 wherein the backwall has a front side and the three banners are arranged in a three sided concave shape facing forwardly.

7. The three banner display of claim 1 further comprising a lower horizontal support member engaged with the third banner, the lower horizontal support member extending between the vertical poles.

8. A three banner display for a trade show or the like comprising three banners, a first end banner extended from a first base of a first retractable banner stand, a second end banner extended from a second base of a second retractable banner stand, a third banner positioned intermediate the first and second banners and intermediate the first and second banner stand and not being extended from a retractable banner stand base, the third banner being supported exclusively by third banner support structure extending from the first base and second base.

9. The three banner display of claim 8 wherein the first banner and the second banner extend the same vertical distance, and the third banner extends higher that said vertical distance.

10. The three banner display of claim 8 wherein the banner support structure comprises a horizontal cross member with two ends, one end positioned above the first base and the other end supported above the second base, and wherein the third banner extends downwardly from said horizontal cross member and there is no banner stand base positioned intermediate the first and second banner stands.

11. The three banner display of claim 10 wherein the horizontal cross member is one of straight and arcuate.

12. The three banner display of claim 10 wherein the banner support structure further comprises a first vertical pole inserted into the first base and a second vertical pole inserted into the second base, and wherein the horizontal cross member connects to each of the first vertical pole and second vertical pole.

13. The three banner display of claim 8 wherein the first banner has a width, the second banner has a width equal to the width of the first banner, and wherein the first base is separated from the second base by a separation distance, said separation distance having a separation width within 10% of the width of the first and second banner.

14. The three banner display of claim 13 wherein the third banner has a width greater than the separation distance and said width is at least as great as the width of the first banner, and wherein the third banner support structure comprises two vertical poles, and a horizontal cross member supported by said two vertical poles, the third banner suspended by said horizontal cross member, one of the vertical poles extending from the first base and one of the vertical poles extending from the second base.

15. The three banner display of claim 8 wherein the first banner has a width, the second banner has a width equal to the width of the first banner, and wherein the first base is separated from the second base by a separation distance, and wherein the banner support structure comprises a horizontal support member from which the banner extends downwardly, said horizontal support member having a length greater than the separation distance, the banner support structure further comprising a pair of vertical poles supporting the horizontal support member, one vertical pole extending from the first base and one vertical pole extending from the second base.

16. A backwall formed from a pair of the retractable banner stands, each retractable banner stand assembly comprising an elongate housing with two ends, the housing having an axis and containing a core with a torsion spring in the core, a banner wound on the core and extendible and retractable out of a elongate slot in the housing, each end having a forward foot and a rearward foot, the housing and feet having a I-shape when viewed from above, each foot having a least one socket for receiving a vertical pole therein the pair of retractable banner stands separated by a separation distance and having a banner support structure extending from each of the pair of banner stand, the support structure supported exclusively by engagement with the sockets, the banner support structure comprising a horizontal support member from which a banner extends downwardly, the backwall further having an attachment accessory for mounting on a vertical pole selected from the set of: shelves, spring clips, literature racks, electronic display screens, and signage.

17. The banner stand assembly of claim 16 wherein each foot being fixed to the housing and configured as a saddle extending under the housing at each end.

18. The banner stand assembly of claim 16 further comprising an additional elongate housing with two ends, the housing having an axis and containing a core with a torsion spring in the core, a banner wound on the core and extendible and retractable out of a elongate slot in the housing, each end having a forward foot and a rearward foot, the housing and feet having a I-shape when viewed from above, each foot having a least one socket for receiving a vertical pole therein, the both housings positioned in linear alignment with one another and spaced apart providing a pair of inwardly positioned, with respect to the other housing, feet, a pair of vertical poles extending from said pair of inwardly positioned feet, each of said vertical poles having a top and a cross member extending between said vertical poles at said tops, a banner extending downwardly for said cross member, said banner having a pair of lower corners.

* * * * *